US009636919B2

(12) United States Patent
Inoue et al.

(10) Patent No.: US 9,636,919 B2
(45) Date of Patent: May 2, 2017

(54) LIQUID DISCHARGE HEAD AND LIQUID DISCHARGE APPARATUS USING THE SAME

(71) Applicant: CANON KABUSHIKI KAISHA, Tokyo (JP)

(72) Inventors: Ryoji Inoue, Kawasaki (JP); Yasuo Kotaki, Yokohama (JP); Tetsuya Ohashi, Matsudo (JP); Hitoshi Takada, Yokohama (JP); Takashi Fukushima, Yokohama (JP); Hironori Murakami, Tokyo (JP); Norihiro Ikebe, Kawasaki (JP); Hironori Fukuchi, Kawasaki (JP); Kyosuke Toda, Kawasaki (JP); Hiroki Hayashi, Kawasaki (JP); Takatoshi Kitagawa, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/141,001

(22) Filed: Apr. 28, 2016

(65) Prior Publication Data

US 2016/0236480 A1 Aug. 18, 2016

Related U.S. Application Data

(62) Division of application No. 14/716,205, filed on May 19, 2015, now Pat. No. 9,352,576.

(30) Foreign Application Priority Data

May 30, 2014 (JP) ..... 2014-112181

(51) Int. Cl.
*B41J 2/175* (2006.01)

(52) U.S. Cl.
CPC ..... *B41J 2/17566* (2013.01); *B41J 2/1752* (2013.01); *B41J 2/1753* (2013.01);
(Continued)

(58) Field of Classification Search
CPC .. B41J 2/17513; B41J 2/1752; B41J 2/17523; B41J 2/1753; B41J 2/17553; B41J 2/17566; B41J 2002/79
See application file for complete search history.

(56) References Cited

U.S. PATENT DOCUMENTS 4,636,814 A 1/1987 Terasawa
5,162,817 A 11/1992 Tajika et al.
(Continued)

FOREIGN PATENT DOCUMENTS

CN 203358051 U 12/2013
WO 2012/121693 A1 9/2012

OTHER PUBLICATIONS

Chinese Office Action dated Jun. 6, 2016, in Chinese Patent Application No. 201510290322.9.

*Primary Examiner* — Anh T. N. Vo
(74) *Attorney, Agent, or Firm* — Fitzpatrick, Cella, Harper & Scinto

(57) ABSTRACT

A liquid discharge head including a liquid storage chamber capable of holding a liquid, a liquid communication pipe communicating with the liquid storage chamber and being configured to supply the liquid from a liquid tank to the liquid storage chamber by installing the liquid tank to the pipe to communicate with the liquid tank, a discharge port communicating with the liquid storage chamber to discharge the liquid, an electrode pair each having an outside end portion located outside the liquid storage chamber and detecting a liquid level of the liquid storage chamber, and an electric contact portion connected to the outside end portion of each of the electrode pair. The electric contact portion is located above the liquid communication pipe with a discharge port surface on which the discharge port opens taking a position facing perpendicularly downward.

18 Claims, 9 Drawing Sheets

(52) U.S. Cl.
CPC ..... *B41J 2/17513* (2013.01); *B41J 2/17523* (2013.01); *B41J 2/17553* (2013.01); *B41J 2002/17579* (2013.01)

(56) References Cited

U.S. PATENT DOCUMENTS

| | | | | | |
|---|---|---|---|---|---|
| 5,255,019 | A * | 10/1993 | Mochizuki | B41J 2/17566 | 101/364 |
| 6,209,980 | B1 * | 4/2001 | Kobayashi | B41J 2/17513 | 347/7 |
| 6,698,869 | B2 | 3/2004 | Vosahlo | | |
| 6,736,496 | B2 | 5/2004 | Hanaoka et al. | | |
| 7,648,230 | B2 | 1/2010 | Kachi | | |
| 8,141,996 | B2 | 3/2012 | Katoh | | |
| 9,352,576 | B2 * | 5/2016 | Inoue | B41J 2/17523 | |
| 2007/0040877 | A1 | 2/2007 | Kachi | | |
| 2009/0290002 | A1 | 11/2009 | Katoh | | |

* cited by examiner

LIQUID DISCHARGE HEAD AND LIQUID DISCHARGE APPARATUS USING THE SAME

BACKGROUND OF THE INVENTION

Field of the Invention

The present invention relates to a liquid discharge head and a liquid discharge apparatus using the same.

Description of the Related Art

A liquid discharge apparatus is used for applying a liquid such as an ink to a recording medium by a liquid discharge head to form an image on the recording medium. The liquid is stored in a liquid tank detachably installed in the liquid discharge head. The liquid is supplied to a subtank (hereinafter referred to as a liquid storage chamber) within the liquid discharge head, and the liquid stored in the liquid storage chamber is supplied to an element substrate provided with a discharge port. When the liquid is consumed, the liquid tank is replaced. A technique for detecting the presence or absence of the liquid has been proposed for notifying a user of the time to replace the liquid tank and has been put into practical use.

International Publication No. WO2012/121693 discloses a liquid discharge head provided with a liquid detection mechanism. The liquid detection mechanism has an electrode pair (fluid sensor) provided in the liquid discharge head. Current flows between electrodes when the electrode pair comes into contact with a liquid. When the liquid level in the liquid storage chamber becomes low, and any one of the electrode pair is separated from the liquid level, the voltage between the electrodes increases. The fluid sensor detects the liquid level on the basis of this principle to detect the situation that the liquid in the liquid tank has been consumed. The liquid discharge head also has an energy-generating element which generates energy for discharging the liquid. The energy-generating element and the electrodes are electrically connected to a body of a liquid discharge apparatus through a common electric contact portion. The liquid discharge head is further provided with a needle-like liquid communication pipe extending through an exterior portion of the liquid tank for taking out the liquid within the liquid tank. When the liquid tank is set at a predetermined installation position, the liquid communication pipe is caused to pass through the exterior portion of the liquid tank to supply the liquid to the liquid storage chamber through the liquid communication pipe.

When the liquid tank is replaced, there is a possibility that a part of the liquid in the liquid tank may leak out of the liquid tank. Specifically, when a used liquid tank is pulled out of the liquid communication pipe or when a new liquid tank is set to cause a liquid communication pipe to pass through the exterior portion of the liquid tank, there is a possibility that the liquid may leak out of a portion through which the liquid communication pipe passes and then attach to the liquid communication pipe. According to the liquid discharge head described in International Publication No. WO2012/121693, the liquid communication pipe is located above the electric contact portion, so that there is a possibility that the liquid attached to the liquid communication pipe may fall and attach to the electric contact portion to cause short circuit at the electric contact portion.

SUMMARY OF THE INVENTION

It is an object of the present invention to provide a liquid discharge head by which a liquid having leaked out when a liquid tank is installed or detached is hard to attach to an electric contact portion.

In order to solve the above problem, the present invention provides a liquid discharge head comprising a liquid storage chamber capable of holding a liquid, a liquid communication pipe communicating with the liquid storage chamber and being configured to supply the liquid from a liquid tank to the liquid storage chamber by installing the liquid tank to the pipe to communicate with the liquid tank, a discharge port communicating with the liquid storage chamber to discharge the liquid, an electrode pair each having an outside end portion located outside the liquid storage chamber and detecting a liquid level of the liquid storage chamber, and an electric contact portion connected to the outside end portion of each of the electrode pair, wherein the electric contact portion is located above the liquid communication pipe with a discharge port surface on which the discharge port opens taking a position facing perpendicularly downward.

The present invention also provides a liquid discharge apparatus including the liquid discharge head described above and a carriage on which the liquid discharge head is mounted.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings. In the embodiments described below, a liquid discharge head discharges a liquid such as an ink while moving against a recording medium to form an image. In this embodiment, a liquid tank is detachably installed in the liquid discharge head to directly supply the liquid to the liquid discharge head from the liquid tank. The liquid tank is mounted together with the liquid discharge head on a carriage which reciprocates (mainly scans). Such a liquid supply method for the liquid discharge head is called an on-carriage system. Since the on-carriage system does not need a part such as a tube for connecting the liquid tank to the liquid discharge head, a compact and low-cost liquid discharge apparatus can be provided. The present invention can be particularly favorably applied to a liquid discharge head and a liquid discharge apparatus of the on-carriage system. However, the present invention can also be applied to a liquid discharge head and a liquid discharge apparatus, wherein no liquid tank is installed in the liquid discharge head, and the liquid tank is connected to the liquid discharge head through a tube. In other embodiments, a fixed liquid discharge head can also discharge a liquid on a moving recording medium to form an image.

Figure 1:
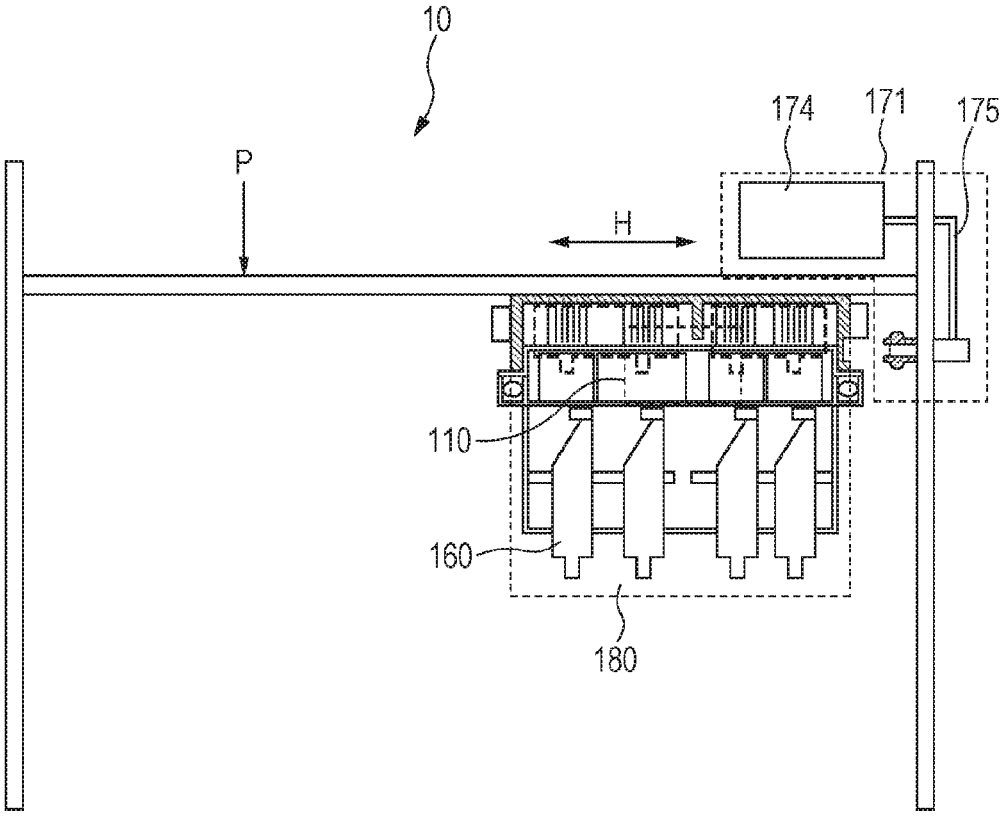
FIG. 1 is a typical plan view illustrating a schematic construction of a liquid discharge apparatus.

A liquid discharge apparatus according to the present invention will be first described. FIG. 1 is a plan view illustrating a schematic construction of the liquid discharge apparatus. The liquid discharge apparatus 10 according to this embodiment is an image recording apparatus of an ink jet system, wherein inks of respective colors of yellow, black, cyan and magenta are discharged on a recording medium to form an image on the recording medium. The liquid discharge apparatus 10 has a liquid discharge head 110 and a carriage 180 on which the liquid discharge head 110 is mounted. A liquid tank 160 can be installed in the liquid discharge head 110 and mounted together with the liquid discharge head 110 on the carriage 180 to move in a main scanning direction H orthogonal to a conveying direction P of a recording medium. The liquid discharge head 110 mounted on the carriage 180 discharges a liquid toward the recording medium while moving in the main scanning direction H to record an image on the recording medium.

Figure 2:
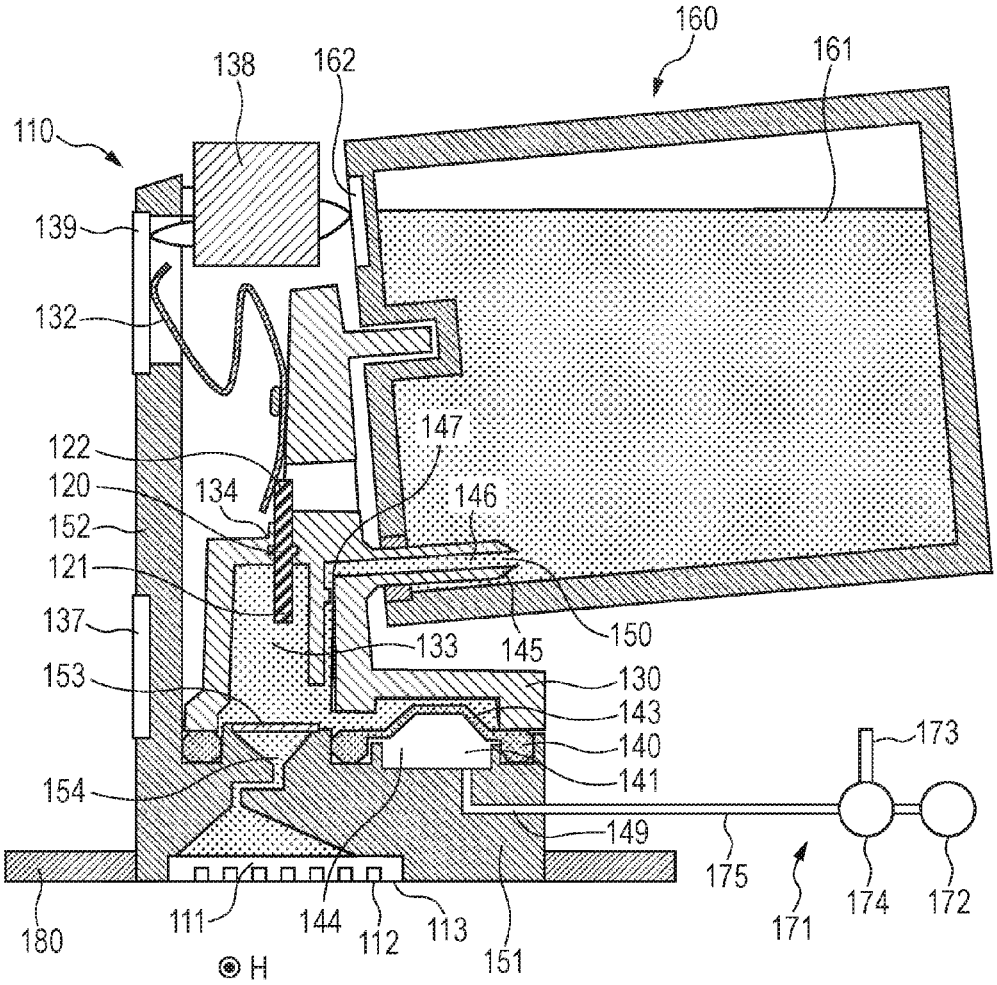
FIG. 2 is a typical sectional view of a liquid discharge head in which a liquid tank is installed.
Figure 3:
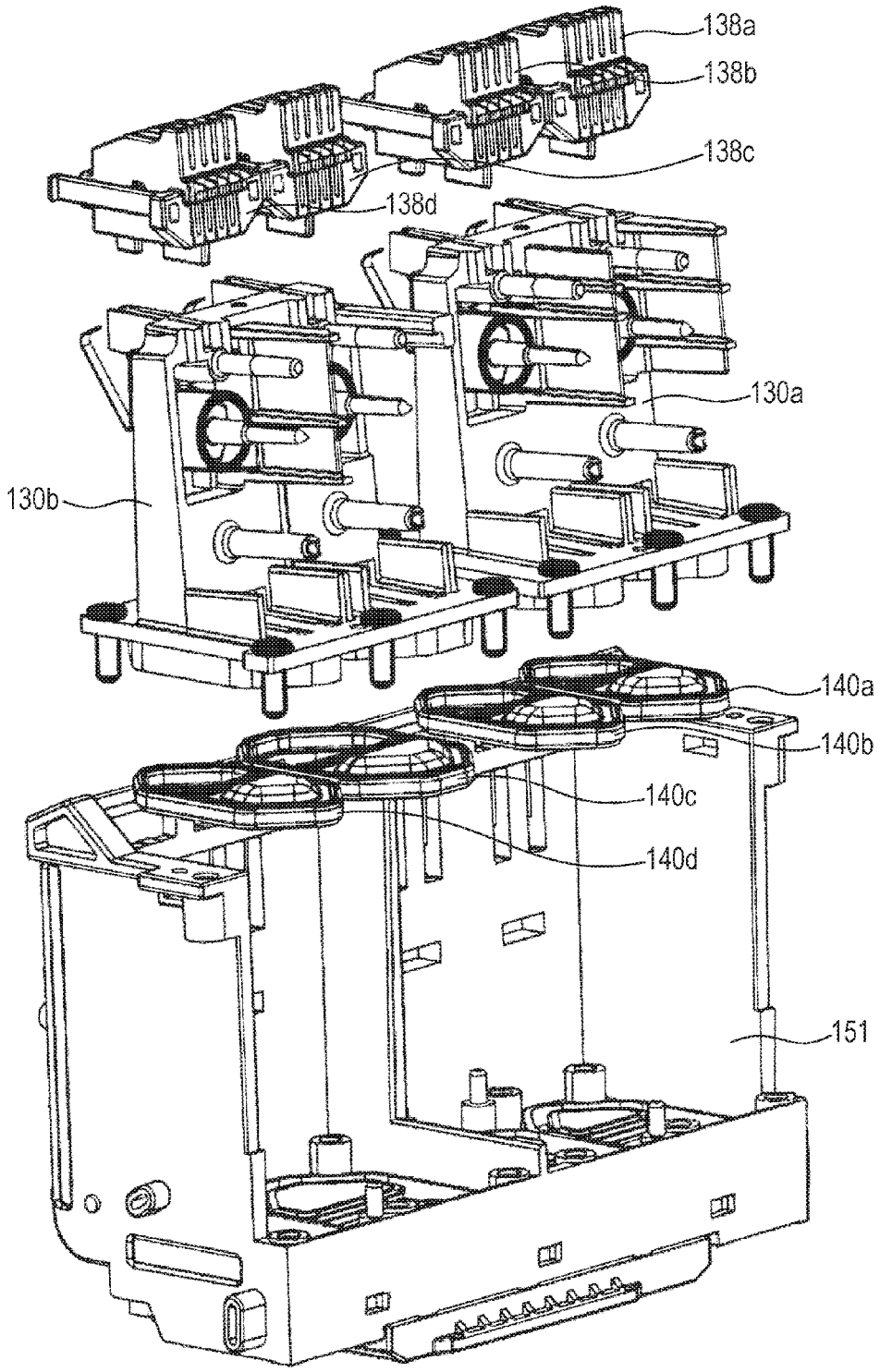
FIG. 3 is an exploded perspective view of the liquid discharge head.
Figure 4:
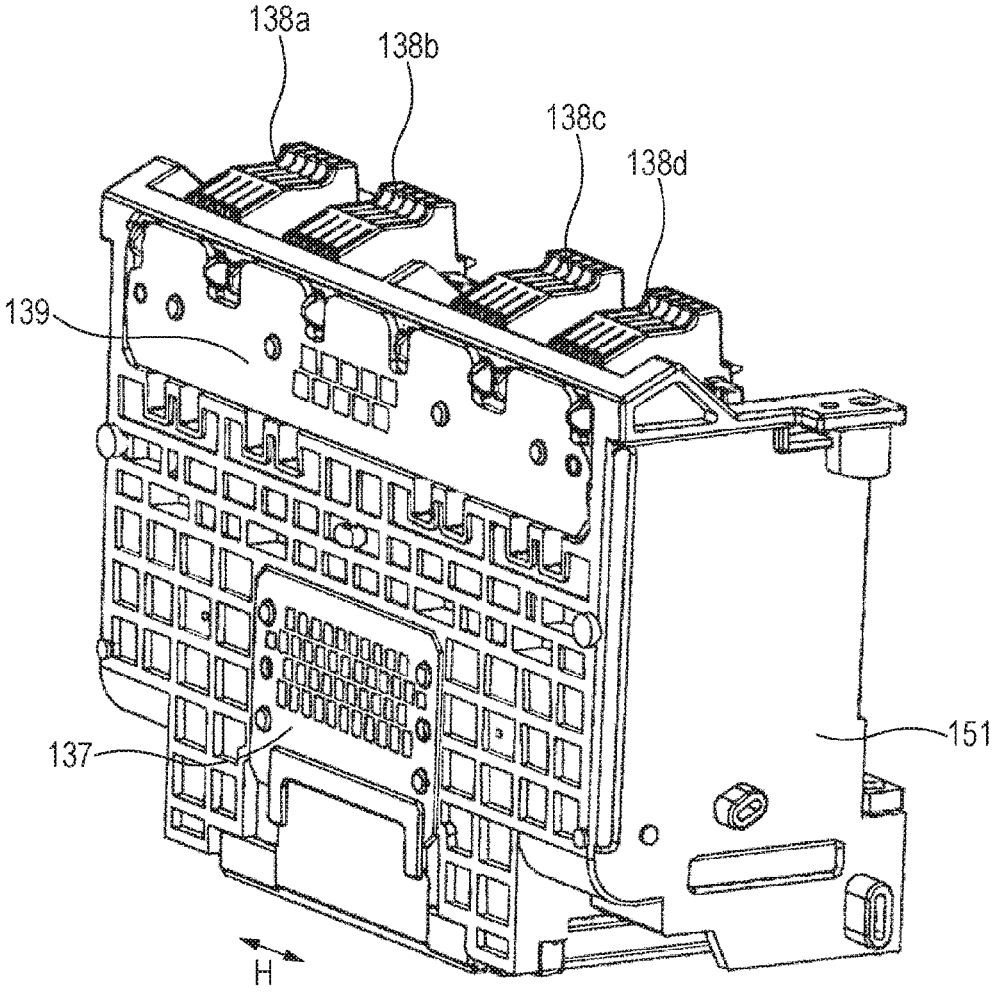
FIG. 4 is a perspective view of the liquid discharge head when viewed from the backside thereof.

FIG. 2 is a typical sectional view of a liquid discharge head according to this embodiment. In FIG. 2, a liquid tank is installed in the liquid discharge head to supply a liquid to the liquid discharge head. FIG. 3 is an exploded perspective view of the liquid discharge head illustrated in FIG. 2. FIG. 4 is a perspective view of the liquid discharge head illustrated in FIG. 2 when viewed from the backside thereof. In the following description, the liquid discharge head is such that a discharge port surface on which a discharge port is formed takes a position substantially facing perpendicularly downward. This position conforms to the position of the liquid discharge head in an installed state of the liquid discharge apparatus 10. In addition, in the present specification, the term "above" means both diagonally above and right above, and the term "below" means both diagonally below and right below.

The liquid discharge head 110 has a joint member 130, a liquid flow path member 151, a sealing member 140, a liquid communication pipe 145 provided at the joint member 130 and an element substrate 111 supported on a support member 151. The sealing member 140 is sandwiched between the joint member 130 and the liquid flow path member 151. The joint member 130 forms a liquid storage chamber 133 capable of holding a liquid supplied from a liquid tank 160 together with the liquid flow path member 151 and the sealing member 140. In this embodiment, the liquid discharge head 110 has four element substrates 111 and four liquid storage chambers 133 respectively corresponding to four color liquids. The joint member 130 is integrally formed for every two colors (joint members 130*a* and 130*b*), and the liquid flow path member 151 is integrally formed for all four colors. The sealing member 140 is provided correspondingly to each joint member 130 (see sealing members 140*a*, 140*b*, 140*c* and 140*d* in FIG. 3). The sealing member 140 is formed of a flexible member such as rubber to enhance the closability of the liquid storage chamber 133.

Figure 5A:
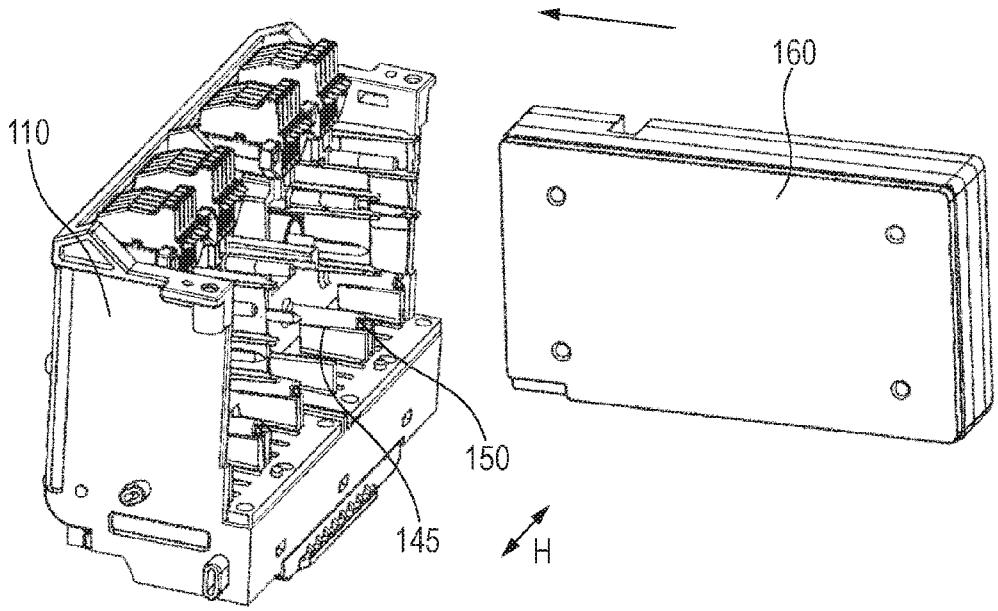
FIGS. 5A and 5B are perspective views illustrating a state in which the liquid tank is installed in the liquid discharge head.
Figure 5B:
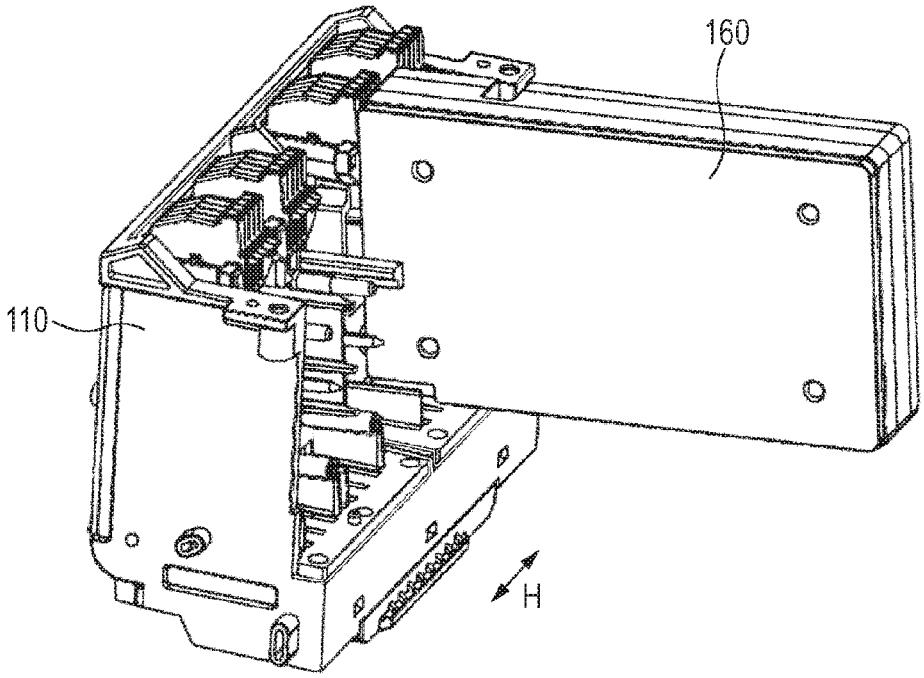

FIGS. 5A and 5B are perspective views illustrating a state in which the liquid tank 160 is installed in the liquid discharge head 110. As illustrated in FIGS. 2, 3 and 5A, a liquid communication pipe 145 is provided on a side surface of the joint member 130. The liquid communication pipe 145 has a needle-like shape and is provided, in the interior thereof, with a flow path 146 through which a liquid can be circulated. The liquid communication pipe 145 extends substantially horizontally from the joint member 130. The liquid communication pipe 145 is formed integrally with the joint member 130, but may also be fixed to the joint member 130 by, for example, welding. When the liquid tank 160 is fitted on the liquid communication pipe 145 along the direction of the arrow in FIG. 5A, a sharp tip 150 of the liquid communication pipe 145 is caused to pass through an exterior portion 161 of the liquid tank 160. FIG. 5B illustrates a state in which the liquid tank 160 is installed in the liquid discharge head 110. The liquid tank 160 is fixed to the liquid discharge head 110 by a coil spring and a release lever (both not illustrated) provided in the liquid discharge head 110. A liquid stored in the liquid tank 160 can be thereby supplied to the liquid discharge head 110. The liquid in the liquid tank 160 is caused to pass through the flow path 146 provided in the interior of the liquid communication pipe 145 and supplied to the liquid storage chamber 133 through an inlet port 147 which is a junction portion between the joint member 130 and the liquid communication pipe 145.

The liquid flow path member 151 has a filter 153 and a liquid supply flow path 154 connecting the filter 153 to the element substrate 111, and the liquid in the liquid storage chamber 133 is supplied to the element substrate 111 through the filter 153 and the liquid supply flow path 154. The element substrate 111 communicates with the liquid storage chamber 133 and has many discharge ports 112 each discharging the liquid and an energy-generating element (not illustrated) which generates energy for discharging the liquid from each discharge port 112. The discharge port 112 opens on a discharge port surface 113 facing a recording medium. In an installed state of the liquid discharge apparatus 10, the discharge port surface 113 is spread substantially horizontally. The liquid is heated by the energy-generating element and discharged toward the recording medium from the discharge port 112 to record an image on the recording medium.

The liquid flow path member 151 has a side wall 152 extending in a substantially vertical direction on the side opposite to the liquid tank 160 with the joint member 130 sandwiched therebetween. A first electric contact portion 139 is provided at an upper portion of a back surface of the side wall 152 when viewed from the liquid tank 160. The first electric contact portion 139 is located outside the liquid storage chamber 133 (joint member 130). A connector member 138 is provided above the joint member 130. The connector member 138 is provided correspondingly to each liquid tank 160 (see connector members 138*a*, 138*b*, 138*c* and 138*d* in FIG. 3). The connector member 138 electrically connects an electric substrate provided on the liquid tank 160 to the first electric contact portion 139 to send liquid remaining amount information of the liquid tank 160 to the body of the liquid discharge apparatus 10 through the first electric contact portion 139.

Figure 6:
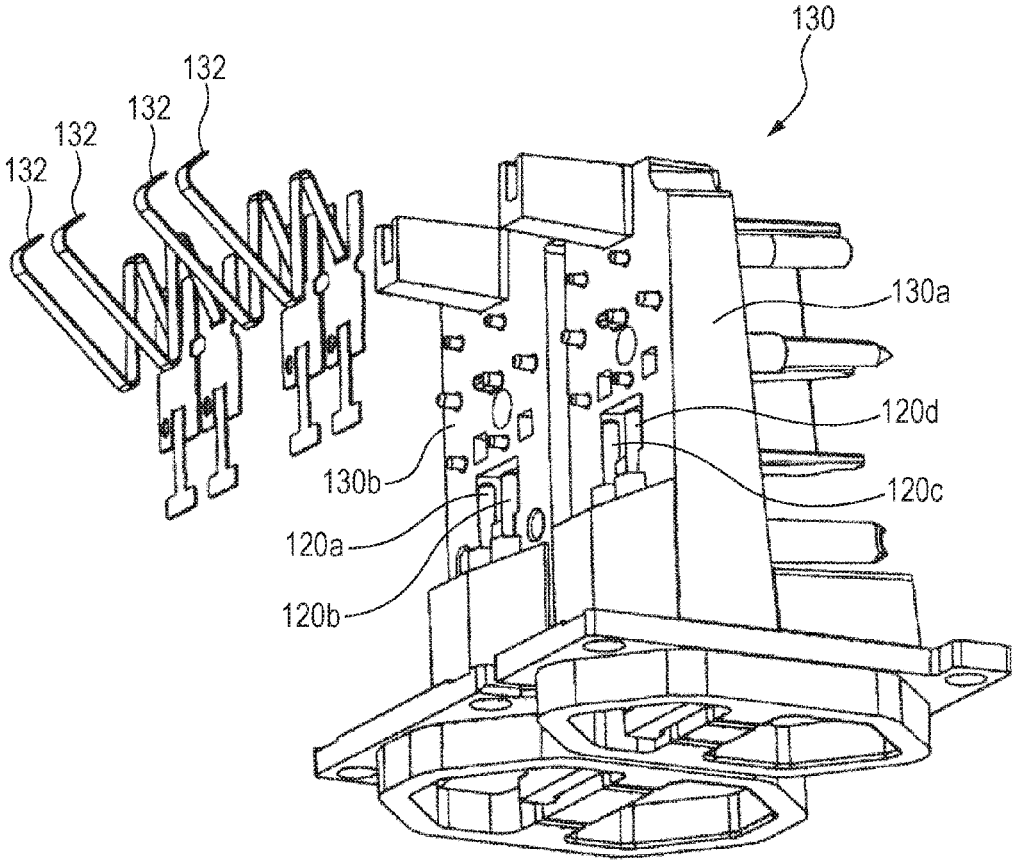
FIG. 6 is an exploded perspective view of a joint member of the liquid discharge head.

An electrode pair 120 detecting a liquid level of the liquid storage chamber 133 is provided passing through a wall constituting the liquid storage chamber 133. Each electrode of the electrode pair 120 has a shape of a pin and extends passing through a top wall 134 of the liquid storage chamber 133 (joint member 130) between an outside end portion 122 located outside the liquid storage chamber 133 and an inside end portion 121 located inside the liquid storage chamber 133. The inside end portion 121 of the electrode pair 120 is located below the liquid communication pipe 145, favorably, below the whole of the liquid communication pipe 145. FIG. 6 is an exploded perspective view of the joint member 130. As illustrated in FIG. 6, two sets of the electrode pair 120 (a set of electrodes 120*a* and 120*b* and a set of electrodes 120*c* and 120*d*) are provided. However, the number of the electrode pair 120 is not limited, and one set or plural sets may also be provided. In the following description, however, the respective electrodes of the electrode pair 120 are represented by the electrodes 120*a* and 120*b*. At least a portion of the electrode pair 120 located in the interior of the liquid storage chamber 133 extends in a vertical direction. In this embodiment, the electrode pair 120 extends in the vertical direction over the entire length, but may also be curved or bent outside the liquid storage chamber 133. The electrode pair 120 is fixed to the top wall of the joint member 130 by insert molding or bonding for ensuring the closability of the liquid storage chamber 133.

Each outside end portion 122 of the electrodes 120*a* and 120*b* of the electrode pair 120 is connected to the first electric contact portion 139 through an electric connection member 132. The electric connection member 132 is formed by an electrically-conductive material, and one end thereof is fixed to the joint member 130 by caulking. The electric connection member 132 has a plurality of curved portions and is compressed between the first electric contact portion 139 and the joint member 130. The other end of the electric connection member 132 is brought into stable contact with a pad (not illustrated) of the first electric contact portion 139 by elastic restoring force generated by the compression. The first electric contact portion 139 is located above the liquid communication pipe 145, favorably, above the whole of the liquid communication pipe 145.

The liquid discharge head 110 has a second electric contact portion 137 connected to the energy-generating element of the element substrate 111. The second electric contact portion 137 is provided on the back surface of the liquid discharge head 110 when viewed from the liquid tank 160, specifically, in a lower portion of the side wall 152 of the liquid flow path member 151 for facilitating the connection to the energy-generating element. The first electric contact portion 139 is located above the second electric contact portion 137.

Figure 7:
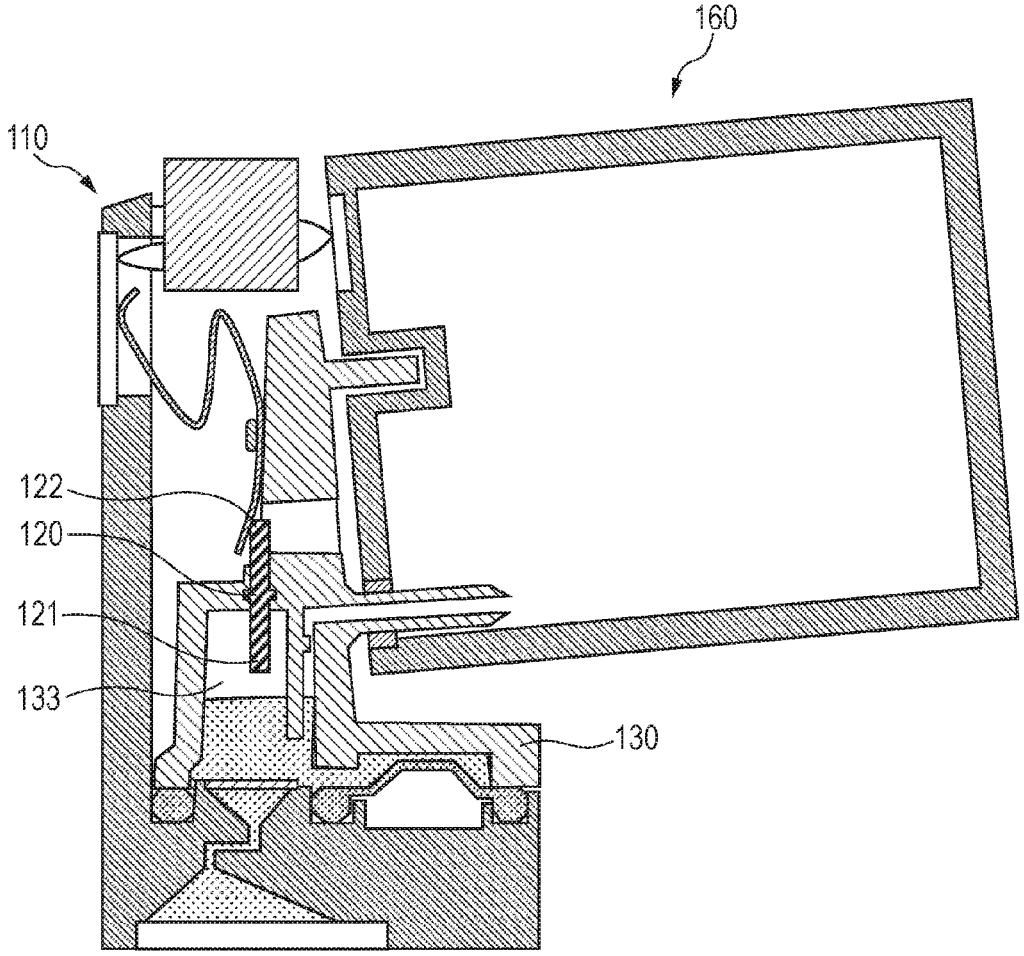
FIG. 7 is a typical sectional view of the liquid discharge head when the liquid tank has become empty.

Each inside end portion 121 of the electrodes 120*a* and 120*b* of the electrode pair 120 detects a liquid level of the liquid storage chamber 133. When the liquid storage chamber 133 is filled with the liquid as illustrated in FIG. 2, or the liquid level of the liquid storage chamber 133 is the same as the inside end portion 121 or located above it, a detection voltage generated between the electrodes remains low owing to the electric-conductivity of the liquid present between the electrodes. That is, when the inside end portion 121 comes into contact with the liquid, the detection voltage generated between the electrodes remains low. When the whole liquid in the liquid tank 160 is consumed, and the liquid level of the liquid storage chamber 133 is lowered below the inside end portion 121 as illustrated in FIG. 7, the detection voltage generated between the electrodes increases. The liquid level can be detected by a difference between the detection voltages in FIG. 2 and FIG. 7. The liquid discharge apparatus 10 reads out the detection voltage generated between the electrodes through the first electric contact portion 139 to notify a user of the situation that the liquid tank 160 has become empty, and the liquid tank 160 needs to be replaced. The used liquid tank 160 is pulled out of the liquid discharge head 110 by the user, and a new liquid tank 160 is installed in the liquid discharge head 110.

Bubbles may be generated in the liquid storage chamber 133 in some cases. When the liquid tank 160 becomes empty and the liquid in the liquid storage chamber 133 is partially consumed, air and the liquid respectively occupy certain volumes within the liquid storage chamber 133. In such circumstances, fine and minute bubbles easily deposit in the vicinity of an interface between the air and the liquid. In this embodiment in particular, the liquid discharge head 110 is mounted on the carriage 180 and reciprocated, so that the air is divided by swinging of the liquid level to easily generate bubbles. When the liquid tank 160 is provided with an air communicating port, air is also introduced into the liquid storage chamber 133 together with the liquid when the amount of the liquid remaining in the liquid tank 160 becomes small. Since the air and the liquid respectively occupy certain volumes within the liquid storage chamber 133 when the electrode pair 120 detects the liquid level, bubbles are easily generated, and the thus-generated bubbles are liable to stay in the liquid storage chamber 133 for a long period of time. When bubbles are present in the liquid storage chamber 133, the liquid level of the liquid storage chamber 133 cannot be precisely detected.

Thus, the liquid discharge head 110 has a pressure control chamber 141 connected to a pressure control unit 171, whose pressure varies according to the operation of the pressure control unit 171, and has an elastic member 143 tightly partitioning the liquid storage chamber 133 and the pressure control chamber 141. The pressure control unit 171 has a decompression pump 172, an atmosphere release pipe 173 and a valve 174 for switching over between the decompression pump 172 and the atmosphere release pipe 173. The elastic member 143 is deformable so as to increase or decrease the capacity of the liquid storage chamber 133 according to the pressure within the pressure control chamber 141. More specifically, in FIG. 2, the sealing member 140 has an elastic member 143 formed by a thin film. The elastic member 143 is housed in an elastic member housing chamber 144, and the elastic member housing chamber 144 is partitioned into the liquid storage chamber 133 and the pressure control chamber 141 by the elastic member 143. The elastic member 143 is a part of the sealing member 140 and formed of a flexible material such as rubber so as to enable it to be deformed in the out-of-plane direction thereof. One end of a decompression flow path 149 opens to the pressure control chamber 141, and the other end of the decompression flow path 149 is connected to a flow path 175 when the carriage 180 reaches a predetermined position. As a result, the pressure control chamber 141 is connected to the decompression pump 172 arranged in the liquid discharge apparatus 10 through the valve 174.

The pressure control chamber 141 is decompressed by driving the decompression pump 172. The elastic member 143 is deformed on the side of the pressure control chamber 141 to increase the capacity of the liquid storage chamber 133. When the liquid tank 160 contains the liquid, the liquid flows into the liquid storage chamber 133. Thereafter, the valve is changed over to allow the pressure control chamber 141 to communicate with the atmosphere release pipe 173, thereby releasing the pressure control chamber 141 to the atmosphere. The elastic member 143 is restored to the original state to decrease the capacity of the liquid storage chamber 133. These operations are repeated, whereby the elastic member 143 acts like a pump to discharge bubbles staying in an upper portion within the liquid storage chamber 133 into the liquid tank 160 through the liquid communication pipe 145. The amount of the bubbles within the liquid storage chamber 133 can be thereby reduced to more precisely detect the liquid level of the liquid storage chamber 133 by the electrode pair 120.

As described above, the inside end portion 121 of the electrode pair 120 is located below the liquid communication pipe 145. The reason for it is as follows. First, the purpose of the electrode pair 120 is to detect whether the liquid tank 160 has become empty or not. Therefore, the liquid level of the liquid storage chamber 133 is required to become lower than the inside end portion 121 of the electrode pair 120 after the liquid tank 160 has become empty. In other words, when the inside end portion 121 of the electrode pair 120 is located above the liquid communication pipe 145, the inside end portion 121 of the electrode pair 120 detects the liquid level of the liquid storage chamber 133 before the liquid tank 160 becomes empty, whereby the above purpose cannot be achieved. The second reason is to transfer bubbles present in the vicinity of the inside end portion 121 of the electrode pair 120 to the liquid tank 160 through the liquid communication pipe 145. Since the inside end portion 121 of the electrode pair 120 is located below the liquid communication pipe 145, bubbles rising by the action of the elastic member 143 can be efficiently guided to the liquid communication pipe 145. The bubbles within the liquid storage chamber 133 can be thereby efficiently removed to more precisely detect the liquid level of the liquid storage chamber 133.

As described above, the first electric contact portion 139 is located above the liquid communication pipe 145. The reason for it is as follows. Since the liquid communication pipe 145 is inserted into the liquid tank 160, a slight amount of the liquid attaches to the liquid communication pipe 145 when the liquid tank 160 is replaced. Since the liquid discharge head 110 is mounted on the carriage 180 and reciprocated, the liquid attached to the liquid communication pipe 145 scatters by acceleration or deceleration of the carriage 180 to be easily transferred. However, since the first electric contact portion 139 is located above the liquid communication pipe 145, a possibility that the liquid attached to the liquid communication pipe 145 may go around the interior of the liquid discharge head 110 to attach to the first electric contact portion 139 is lowered. In addition, even when the liquid attaches to the first electric contact portion 139, the amount of the liquid attached to the first electric contact portion 139 can be reduced. A possibility of short-circuiting the first electric contact portion 139 can be thereby reduced to ensure the reliability of electric connection.

In the on-carriage supply system, the liquid discharge head 110 approaches the liquid tank 160, so that a portion of the liquid communication pipe 145 where the liquid easily attaches is close to the liquid storage chamber 133. Accordingly, the portion where the liquid easily attaches is liable to approach the outside end portion 122 of the electrode pair 120 arranged in the vicinity of the liquid storage chamber 133. As a result, the first electric contact portion 139 connected to the outside end portion 122 of the electrode pair 120 is also liable to approach the portion where the liquid easily attaches. In this embodiment, the first electric contact portion 139 is connected to the outside end portion 122 of the electrode pair 120 through the electric connection member 132, so that the first electric contact portion 139 can easily be arranged above. In addition, in this embodiment, the second electric contact portion 137 arranged at a lower portion of the liquid discharge head 110 for facilitating the electric connection to the energy-generating element is provided separately from the first electric contact portion 139. Therefore, the first electric contact portion 139 is easily arranged farther above.

Figure 8A:
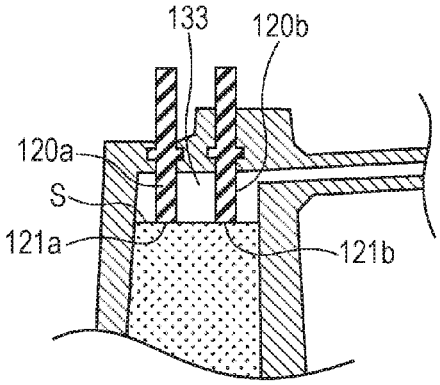
FIGS. 8A and 8B are typical sectional views illustrating the interior of a liquid storage chamber when bubbles are absent.
Figure 8B:
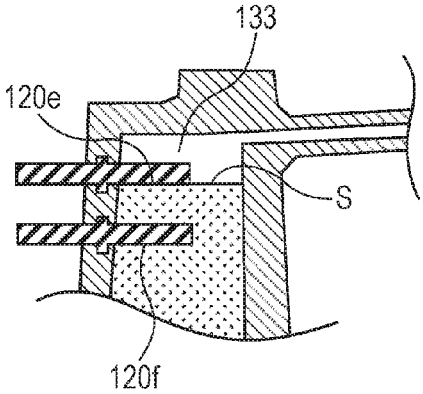

The construction of the electrode pair 120 will now be described in more detail. FIGS. 8A and 8B are typical sectional views illustrating the interior of the liquid storage chamber 133 when bubbles are absent. FIGS. 8A and 8B and FIGS. 9A and 9B illustrate two electrodes of the electrode pair for the sake of convenience. FIG. 8A illustrates the electrode pair 120 (electrodes 120*a* and 120*b*) extending in a vertical direction, and FIG. 8B illustrates the electrode pair 120 (electrodes 120*e* and 120*f*) extending in a horizontal direction at the heights different from each other. In FIG. 8A, the inside end portions 121*a* and 121*b* of both electrodes 120*a* and 120*b* are located at the same height as each other and are in contact with the liquid level S. In FIG. 8B, the whole of the electrode 120*f* located on the lower side is located below the liquid level S, and a lower surface of the electrode 120*e* located on the upper side is in contact with the liquid level S. Surface areas of the respective electrodes 120*a*, 120*b*, 120*e* and 120*f* in the interior of the liquid storage chamber 133, that is, liquid level detecting areas of the respective electrodes are equal to one another. When the liquid level of the liquid storage chamber 133 becomes lower than the liquid level S illustrated in FIGS. 8A and 8B, a detection voltage rapidly increases to detect the liquid level. Since the electric conductivity of the liquid is high, there is no interrelation between the contact area between the electrodes and the liquid and the detection voltage. When a part of the electrodes is in contact with the liquid, the detection voltage remains low. When the electrodes are in no contact with the liquid, the detection voltage greatly increases. In this respect, there is no great difference between the electrode pair (FIG. 8A) extending vertically and the electrode pair (FIG. 8B) extending horizontally.

Figure 9A:
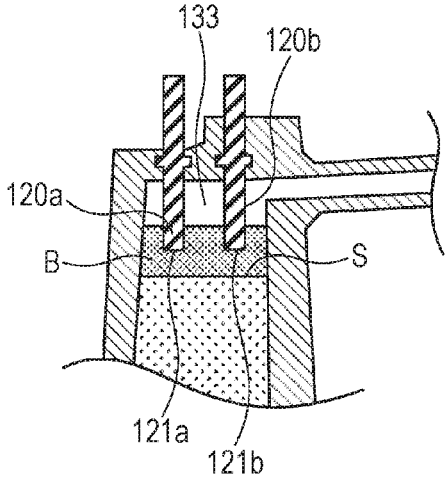
FIGS. 9A and 9B are typical sectional views illustrating the interior of the liquid storage chamber when the bubbles are present.
Figure 9B:
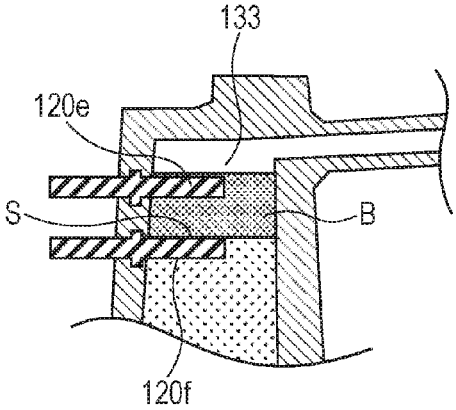

As descried above, however, there is a possibility that bubbles may be present in the vicinity of the liquid level of the liquid storage chamber 133. FIGS. 9A and 9B are typical sectional views illustrating the interior of the liquid storage chamber 133 when bubbles are present. FIGS. 9A and 9B correspond to FIGS. 8A and 8B, respectively. Bubbles are present in the vicinity of an interface between air and the liquid unlike FIGS. 8A and 8B. In FIG. 9A, the inside end portions 121*a* and 121*b* of both electrodes 120*a* and 120*b* are located at the same height as each other and present together in the bubbles B. In FIG. 9B, the whole of the electrode 120*f* located on the lower side is located below the liquid level S, and the electrode 120*e* located on the upper side is present in the bubbles B. In any case, at least one electrode is located above the liquid level S, and conductivity is produced by the bubbles B. As a result, in FIGS. 9A and 9B, an intermediate voltage between a detection voltage in the case where both electrodes are in contact with the liquid and a detection voltage in the case where both electrodes are in contact with air alone is detected. In addition, the electric resistance when the electrodes are in contact with the bubbles is influenced by an area where the electrodes are in contact with the bubbles, unlike the case where the electrodes are in contact with the liquid. In FIG. 9A, both electrodes 120*a* and 120*b* are in contact with the bubbles B, while in FIG. 9B, the electrode 120*e* located on the upper side is in contact with the bubbles B, but the electrode 120*f* located on the lower side is present in the liquid, so that a difference is created between electric resistance values. Therefore, the detection voltage in FIG. 9A becomes higher than the detection voltage in FIG. 9B.

Figure 10:
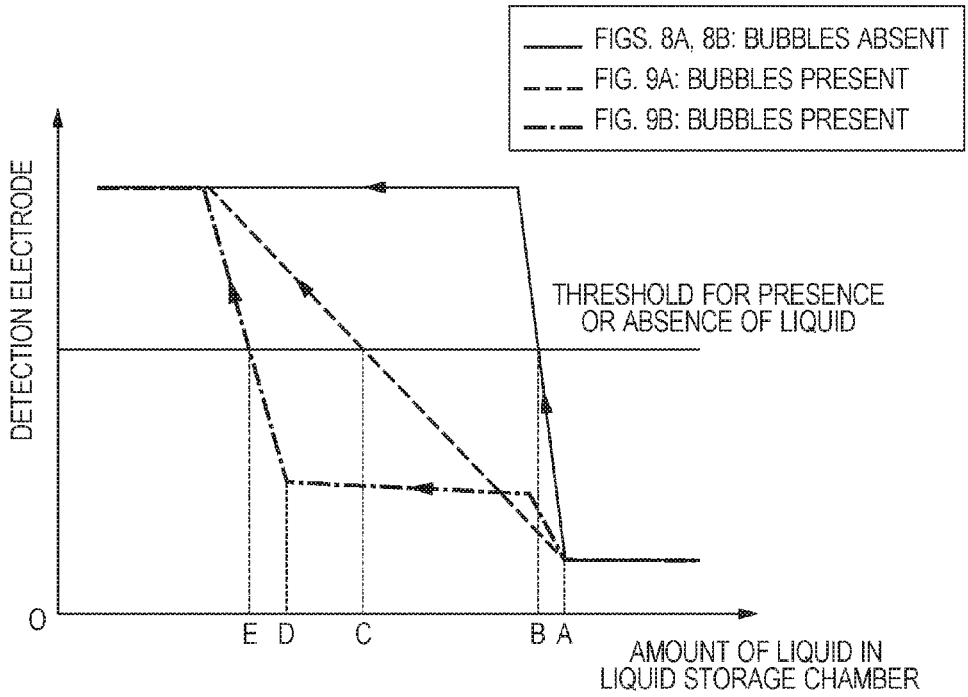
FIG. 10 is a graph illustrating the relation between the amount of a liquid (a liquid level) and the detection voltage between electrodes.

FIG. 10 is a graph illustrating the relation between the amount of the liquid (a position of the liquid level) and the detection voltage between the electrodes. The axis of abscissa indicates the amount of the liquid (the position of the liquid level), and the axis of ordinate indicates the detection voltage between the electrodes. The solid line indicates a state in which bubbles are absent as illustrated in FIGS. 8A and 8B. There is no difference between the electrode pair 120 (FIG. 8A) extending vertically and the electrode pair 120 (FIG. 8B) extending horizontally. The detection voltage rapidly increases at a point A where the amount of the liquid in the liquid storage chamber 133 is decreased, and the liquid level is separated from the inside end portions 121 of the electrodes and exceeds a threshold value for judging the presence or absence of the liquid at a point B to detect the situation that the liquid tank 160 has become empty. Thereafter, the amount of the liquid in the liquid storage chamber 133 is more decreased, but the voltage remains high.

The broken line indicates a detection voltage in case where the electrode pair 120 extends in the vertical direction, and the bubbles are present (FIG. 9A). The inside end portions 121 of the electrode pair 120 are separated from the liquid level at the point A. However, the detection voltage does not rapidly increase because the bubbles B are present between the electrodes, but gradually increases according to the contact area between the electrodes 120*a* and 120*b* and the bubbles B. The detection voltage exceeds the threshold value for judging the presence or absence of the liquid at a point C to detect the situation that the liquid tank 160 has become empty. Thereafter, the contact area between the electrodes 120*a* and 120*b* and the bubbles B gradually decreases, and the detection voltage gradually increases in accordance with this. When the bubbles B are separated from the electrodes 120*a* and 120*b*, the detection voltage becomes constant.

The alternate long and short dash line indicates a detection voltage in the case where the electrode pair 120 extends in the horizontal direction, and the bubbles are present (FIG. 9B). The lower surface of the electrode 120*e* located on the upper side is separated from the liquid level at the point A. However, the detection voltage somewhat increases because the electrode 120*e* located on the upper side is covered with the bubbles B. Thereafter, the amount of the liquid is decreased, but the detection voltage is kept in an almost constant state because the contact area between the electrode 120*e* located on the upper side and the bubbles B does not change. When the amount of the liquid is more decreased, the top portions of the bubbles reach the upper surface of the electrode 120*e* located on the upper side at a point D. The contact area between the electrode 120*e* located on the upper side and the bubbles B gradually decreases, and the detection voltage gradually increases and exceeds the threshold value for judging the presence or absence of the liquid at a point E to detect the situation that the liquid tank 160 has become empty.

When the bubbles are present between the electrodes as described above, the resistance between the electrodes does not rapidly increase even when the liquid level becomes lower than the electrodes, and so a liquid level detection error is caused. When the electrode pair 120 is vertically arranged, the amount of the liquid at the point of detection of the situation that the liquid tank 160 has become empty varies in the range from the point B to the point C according to the presence or absence of the bubbles. On the other hand, when the electrode pair 120 is horizontally arranged, the amount of the liquid at the point of detection of the situation that the liquid tank 160 has become empty varies in the range from the point B to the point E according to the presence or absence of the bubbles. That is, in the electrode pair 120 extending horizontally, the liquid level detection error becomes very great, and so a liquid storage chamber 133 with a high overall height is required for correcting this error. In other words, in the electrode pair 120 extending vertically, a liquid storage chamber 133 smaller in capacity compared with the electrode pair 120 extending horizontally can be used, and so the resulting liquid discharge head 110 can be made compact (miniaturized).

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application is a divisional application of U.S. patent application Ser. No. 14/716,205, filed May 19, 2015, which claims the benefit of Japanese Patent Application No. 2014-112181, filed May 30, 2014, both of which are hereby incorporated by reference herein in their entireties.

What is claimed is:

1. An apparatus comprising:

a liquid storage chamber capable of holding a liquid;

a liquid communication pipe communicating with the liquid storage chamber and being configured to supply the liquid from a liquid tank to the liquid storage chamber by connecting the liquid tank to the pipe to communicate with the liquid tank;

an electrode pair, each having an outside end portion located outside the liquid storage chamber and detecting a liquid level of the liquid storage chamber; and an electric contact portion connected to the outside end portion of each electrode of the electrode pair, wherein when the apparatus is in use, the electric contact portion is located above the liquid communication pipe, and wherein the electrode pair extends through a wall of the liquid storage chamber, with the outside end portions being outside the liquid storage chamber and inside end portions located in the interior of the liquid storage chamber, and the inside end portions are located below the liquid communication pipe.

2. The apparatus according to claim 1, wherein a portion of the electrode pair located in the interior of the liquid storage chamber extends in a vertical direction.

3. The apparatus according to claim 1, further comprising a pressure control chamber connected to a pressure control unit whose pressure varies according to operation of the pressure control unit, and an elastic member tightly partitioning the liquid storage chamber and the pressure control chamber and being deformable so as to increase or decrease the capacity of the liquid storage chamber according to the pressure within the pressure control chamber.

4. The apparatus according to claim 1, wherein plural sets of electrode pairs are provided.

5. The apparatus according to claim 1, wherein the liquid tank is detachably fitted on the liquid communication pipe.

6. The apparatus according to claim 1, wherein a discharge port communicating with the liquid storage chamber to discharge the liquid is provided.

7. The apparatus according to claim 6, further comprising an energy-generating element configured to generate energy for discharging the liquid, wherein the energy-generating element is connected to another electric contact portion that is different from the electric contact portion connected to the electrode pair, and the other electric contact portion connected to the energy-generating element is located below the electric contact portion connected to the electrode pair.

8. The apparatus according to claim 1, wherein the electrode pair is curved or bent outside the liquid storage chamber.

9. The apparatus according to claim 1, wherein the electrode pair is connected to the electric contact portion through an electric connection member.

10. The apparatus according to claim 1, wherein the electric contact portion is exposed to the outside of the apparatus.

11. A liquid discharge head comprising:

a liquid storage chamber capable of holding a liquid;

a liquid communication pipe communicating with the liquid storage chamber and being configured to supply the liquid from a liquid tank to the liquid storage chamber by connecting the liquid tank to the pipe to communicate with the liquid tank;

a discharge port communicating with the liquid storage chamber to discharge the liquid;

an electrode pair, each having an outside end portion located outside the liquid storage chamber and detecting a liquid level of the liquid storage chamber; and an electric contact portion connected to the outside end portion of each electrode of the electrode pair, the electric contact portion being exposed to the outside of the apparatus, wherein the electric contact portion is located above the liquid communication pipe with a discharge port surface on which the discharge port opens facing perpendicularly downward, and wherein the electrode pair extends through a wall of the liquid storage chamber, with the outside end portions being outside the liquid storage chamber and inside end portions located in the interior of the liquid storage chamber, and the inside end portions are located below the liquid communication pipe.

12. The liquid discharge head according to claim 11, wherein a portion of the electrode pair located in the interior of the liquid storage chamber extends in a vertical direction.

13. The liquid discharge head according to claim 11, further comprising a pressure control chamber connected to a pressure control unit whose pressure varies according to operation of the pressure control unit, and an elastic member tightly partitioning the liquid storage chamber and the pressure control chamber and being deformable so as to increase or decrease the capacity of the liquid storage chamber according to the pressure within the pressure control chamber.

14. The liquid discharge head according to claim 11, wherein plural sets of electrode pairs are provided.

15. The liquid discharge head according to claim 11, wherein the liquid tank is detachably fitted on the liquid communication pipe.

16. The liquid discharge head according to claim 11, further comprising an energy-generating element configured to generate energy for discharging the liquid, wherein the energy-generating element is connected to another electric contact portion that is different from the electric contact portion connected to the electrode pair, and the other electric contact portion connected to the energy-generating element is located below the electric contact portion connected to the electrode pair.

17. The liquid discharge head according to claim 11, wherein the electrode pair is curved or bent outside the liquid storage chamber.

18. The liquid discharge head according to claim 11, wherein the electrode pair is connected to the electric contact portion through an electric connection member.

* * * * *